United States Patent [19]

Andersson

[11] Patent Number: 4,501,510

[45] Date of Patent: Feb. 26, 1985

[54] APPARATUS FOR FEEDING SHEETS OF MATERIAL AND CONTINUOUS WEBS IN PRINTERS AND TYPEWRITERS

[75] Inventor: Leif H. Andersson, Åtvidaberg, Sweden

[73] Assignee: Facit Aktiebolag, Åtvidaberg, Sweden

[21] Appl. No.: 503,368

[22] PCT Filed: Sep. 27, 1982

[86] PCT No.: PCT/SE82/00298

§ 371 Date: May 31, 1983

§ 102(e) Date: May 31, 1983

[87] PCT Pub. No.: WO83/01227

PCT Pub. Date: Apr. 14, 1983

[30] Foreign Application Priority Data

Oct. 9, 1981 [SE] Sweden ..... 8106001

[51] Int. Cl.[3] ..... B41J 11/32

[52] U.S. Cl. ..... 400/616.3; 400/635; 400/616.1; 271/275; 226/76; 226/171

[58] Field of Search ..... 400/605, 616.3, 629, 400/616, 616.1, 616.2, 617, 624, 635, 636.1, 636.3; 226/74, 75, 76, 79, 82, 83, 86, 170, 171; 271/275

[56] References Cited

U.S. PATENT DOCUMENTS

| | | | |
|---|---|---|---|
| 830,480 | 9/1906 | Kavle . | |
| 2,131,152 | 9/1938 | Stickney | 400/637 X |
| 2,280,095 | 4/1942 | Metzner | 400/616.3 X |
| 2,426,333 | 8/1947 | Antrim et al. . | |
| 3,421,612 | 1/1969 | Pitt . | |
| 3,747,820 | 7/1973 | Hawxhurst | 226/74 |
| 4,368,994 | 1/1983 | Sweeney | 400/616.1 X |

FOREIGN PATENT DOCUMENTS

| | | |
|---|---|---|
| 56955 | 8/1982 | European Pat. Off. . |
| 409188 | 6/1979 | Sweden . |
| 1448056 | 9/1976 | United Kingdom . |

*Primary Examiner*—Edgar S. Burr
*Assistant Examiner*—Charles A. Pearson
*Attorney, Agent, or Firm*—Roberts, Spiecens and Cohen

[57] ABSTRACT

A feed mechanism for sheets of material or continuous webs in a printer or typewriter, comprising a pin wheel feed mechanism for the feeding of continuous webs and a friction feed mechanism for the feeding of sheets of paper as well as the webs. The pin wheel feed mechanism and the friction feed mechanism are coupled together in at least two separate units for the feeding of the webs. During feeding of the webs the frictional feed pressure is reduced compared to that prevailing during friction feed of the sheets when the pin wheel feed mechanism is inactive.

10 Claims, 5 Drawing Figures

APPARATUS FOR FEEDING SHEETS OF MATERIAL AND CONTINUOUS WEBS IN PRINTERS AND TYPEWRITERS

FIELD OF THE INVENTION

The present invention relates to a feed mechanism for webs in the form of continuous sheets of paper for a printer or typewriter.

BACKGROUND

Normally, printers and typewriters are designed for printing on sheets of paper, usually of the format A4, said sheets being placed in the machine so as to present either the short or the long edge in the direction of feed. The machines are equipped with friction drive means including rollers or belts which co-operate with a platen or with idle rollers of a different kind for the feeding of a sheet of paper. Such machines are also used with continuous forms which have rows of holes along their side edges in the direction of feed and in which engage pin wheels provided for the driving of the said forms. Most often the pin wheel drive means are included in a separate unit connected to the machine, preferably in a way involving the inactivation of the friction drive means. The pin wheel drive means may include a separate drive motor or may be connected to the drive motor for the friction drive means.

The need for a separate unit when using continuous forms with existing printers and typewriters constitutes an obvious drawback.

SUMMARY OF THE INVENTION

A primary object of the invention is to remedy the drawback indicated and to provide a feed mechanism for paper sheets or continuous webs or forms, the use of which in a printer or a typewriter permits the use of paper sheets or continuous forms without the need for any supplemental device.

The object is achieved in a feed mechanism having friction feed means driven from a drive source for feeding the sheets or webs and means provided with projections releasably connected to the friction drive means for drive thereby to feed the web via holes therein in combination with the feed by the friction drive means.

In further accordance with the invention, the feed pressure of the friction drive means is reduced when feeding the web.

BRIEF DESCRIPTION OF THE DRAWINGS

An embodiment of the invention will now be described with reference to the accompanying drawings.

DETAILED DESCRIPTION

Figures 1, 1A:
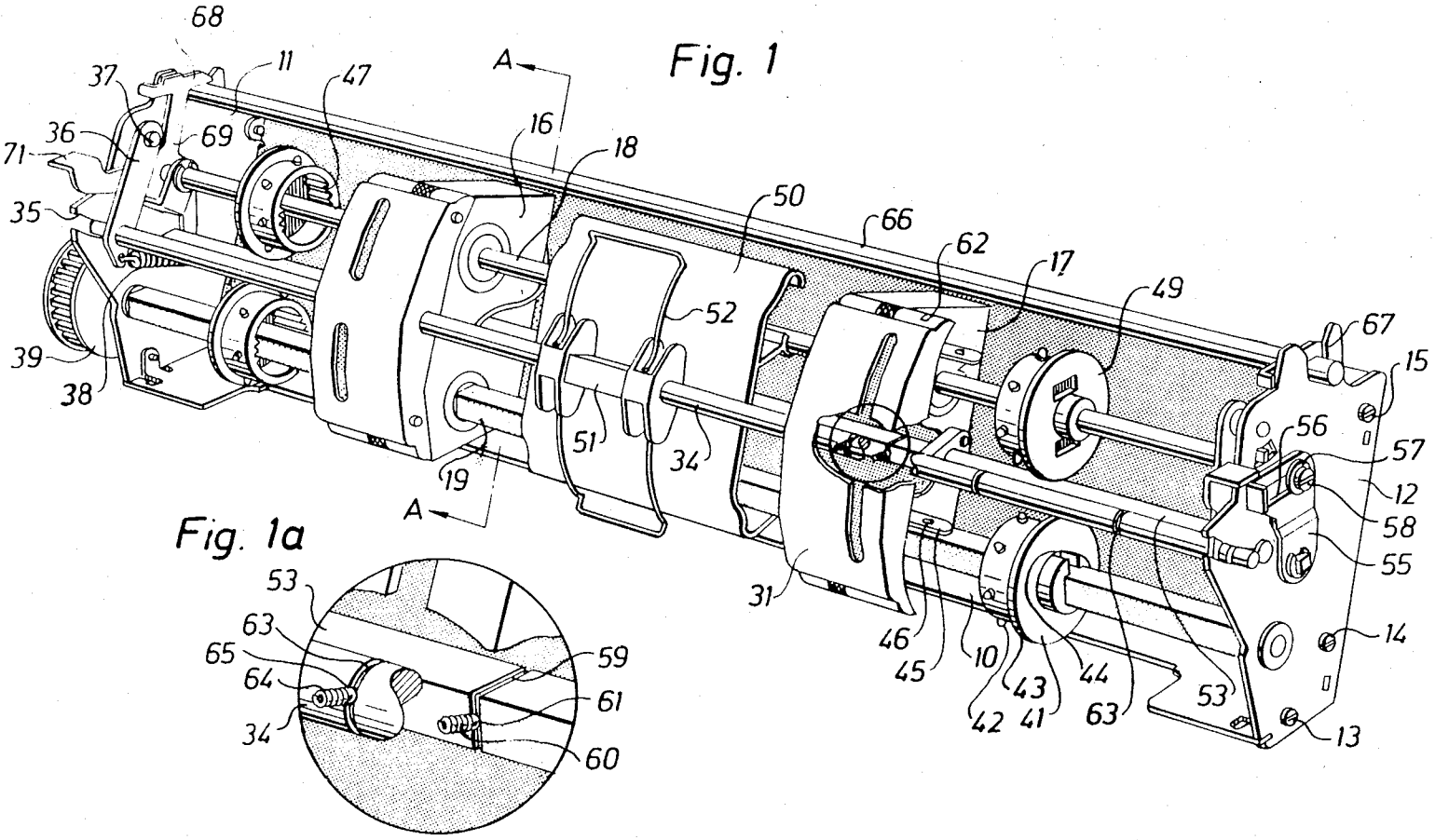
FIG. 1 is a perspective view of a paper feed mechanism according to the invention and intended to be included in a printer, not shown.
FIG. 1*a* is a detail view of parts of FIG. 1.

In the embodiment shown a paper feed unit built up on a frame comprising an elongate frame portion 10 forming the bottom and back parts of the frame and two end walls 11, 12 secured to the frame portion 10 by means of screws 13, 14, 15. Two feed units 16, 17 for frictional feeding of paper sheets are journalled on shafts 18, 19 along which the units can be displaced to be set for different sheet widths.

Figure 2:
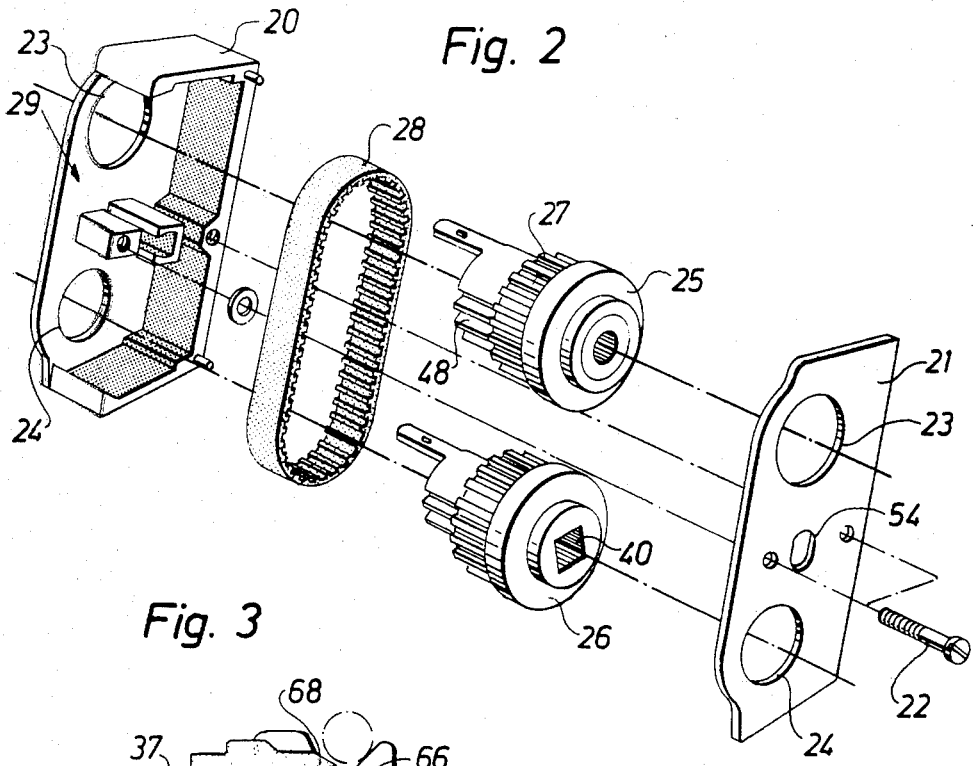
FIG. 2 is an exploded view of a feeding unit included in the feed mechanism of FIG. 1.

FIG. 2 shows the structure of a friction feed unit. The unit comprises a casing 20 covered by a cover 21 which is secured to the casing by screws 22. Holes 23, 24 in the cover co-operate in pairs with holes 23, 24 in the casing to journal two gears 25, 26 which are supported on the shafts 18 and 19, respectively, in the frame. The gears have cogs 27 which mesh with a cog belt 28 interconnecting the two gears 25, 26 and transmitting movement from the gear 26 to the gear 25. The casing 20 has an opening 29 which exposes the smooth outer surface of the cog belt 28. The smooth surface is intended to be pressed against a sheet of paper, not shown, by idle rollers 30, see FIG. 3. The idle rollers are arranged in tractor covers 31 of which one is provided for each feed unit. In the cover 31, four rollers 30 in pairs are journalled on arms 32 which in turn are pivotally journalled on pins 33 in the cover. Hereby the rollers can set for an even contact pressure to be achieved against the sheet in four points. The two tractor covers 31 are swingably journalled on a shaft 34, the ends of which engage in grooves 35 in the two end walls 11, 12. At its ends, the shaft 34 is supported by arms 36 which by pins 37 are swingably journalled in the respective end walls 11, 12. Springs 38 pull the shaft 34 in a direction towards the bottom of the grooves 35 and determine the force by which the idle rollers will press a sheet of paper against the cog belts 28.

The cog belts 28 are driven via a shaft 19 which is connected to a driving wheel 39 driven by an electric motor, not shown. The shaft 19 has a square section engaged in a corresponding hole 40 in each gear 26. Via the cog belt 28 motion is transmitted to the gear 25, which is journalled to rotate freely on the shaft 18. By the co-operating cog belt 28 and gears 25, 26 an extended driving surface will be provided which acts upon the paper sheet causing a very even feed of the sheet to be achieved.

For the feed of continuous forms, pin wheels 41 are displaceably journalled on the shaft 19, one wheel to the left of the feed unit 16 and another to the right of the unit 17 in FIG. 1. In the usual way the wheels 41 are provided with feed pins 42 as well as with a flange 43, the function of which will appear more in detail below. The wheels 41 are connectible to the gears 26 in the respective feed unit 16, 17 and for this purpose each wheel has an axial hole 44 in which a coupling part 45 on the gear 26 can engage. A dog 46 on the coupling part 45 co-operates with the edge of the hole 44 to lock the two wheels 26, 41 in their position of interconnection. Splined portions 47 in the pin wheels 41 co-operate with corresponding portions 48 on the coupling part 45 for transmitting turning motion to the pin wheels 41 in supplement to the driving engagement of square shaft 19 in wheel 41. On the shaft 18 there are rotatably journalled pin wheels 49 which essentially have the same shape as the pin wheels 41 and which in the same way as these wheels are connectible to the corresponding gears 25 in the respective feed unit 16, 17.

For the guidance of a web between the feed units 16, 17 a guide plate 50 is provided having a shape conforming with the bending of the web as caused by the cog belt 28 and the idle rollers 30 in the respective feed unit. The guide plate 50 co-operates with a holder-on plate 51 secured to the shaft 34 and having rectangular wire loops 52 which are directed upwards and downwards and have a shape corresponding to the shaft of the guide plate 50. At both sides of the guide plate 50 the respective feed unit 16, 17 can be displaced to be set in the desired position. Locking of the respective feed unit in the set position is obtained by turning of a square 53 which is journalled in the end walls 11, 12 and which extends through an oval hole 54 provided in the feed unit. Turning of the shaft 53 locks the square shaft in the oval hole 54 and turning of the shaft is effected by means of an operating lever 55, the movement of which is limited by a groove 56 in the lever. The groove co-operates with a pin 57 which by a screw 58 is fixed to that end of the shaft 18 which is positioned at the end wall 12. Each feed unit 16, 17 can be set also in preprogrammed positions determined by grooves 59 in the shaft 53, as seen in FIG. 1*a*. A ball 61 can be caused to fall into the grooves under the biassing action of a spring 60, the ball being provided in a recess in the casing 20 of the feed unit.

The tractor covers 31 are displaceable on the shaft 34 into positions associated with the positions of the feed units. To facilitate setting of the tractor covers 31 these have been provided with a groove 62 intended to co-operate with the flange 43 on the pin wheel 49. In positioning the right-hand cover 31 in FIG. 1 over the feed unit 17 the cover is pivoted towards the wheel 49 and when the cover has taken the correct position the flange 43 falls into the groove 62. The flange 43 and the groove 62 co-operate only during the positioning of the tractor cover and, normally, they are positioned apart. Alternatively, the tractor cover can be designed such that during feeding by means of the pin wheels, the flange 43 rotates in the groove 62 preventing the tractor cover from being laterally displaced. Grooves 63 in the shaft 34 correspond to the preprogrammed positions determined by the grooves 59 in the shaft 53. A ball 65 biassed by a spring 64 and provided in a recess in the cover 31 co-operates with the grooves 63. Accordingly, when any of the feed units 16, 17 has been set in a preprogrammed position determined by a groove 59 in the shaft 53 the corresponding tractor cover 31 can be set in the corresponding position on the shaft 34 by being displaced until the ball 65 falls into the groove 63 provided for this position.

When the paper feed mechanism is to be used for feeding of sheets of paper, a sheet magazine is provided above the feed mechanism in a way not shown in detail. The sheet magazine comprises a shaft 66 which can be inserted into grooves 67 provided in the end walls 11, 12. The shaft 66 is locked in the groove 67 by a hook-shaped locking part 68 on an actuating lever 69 turnably journalled on the shaft 18. Such an actuating lever is provided close to the groove 67 in the respective end wall 11, 12.

Figure 3:
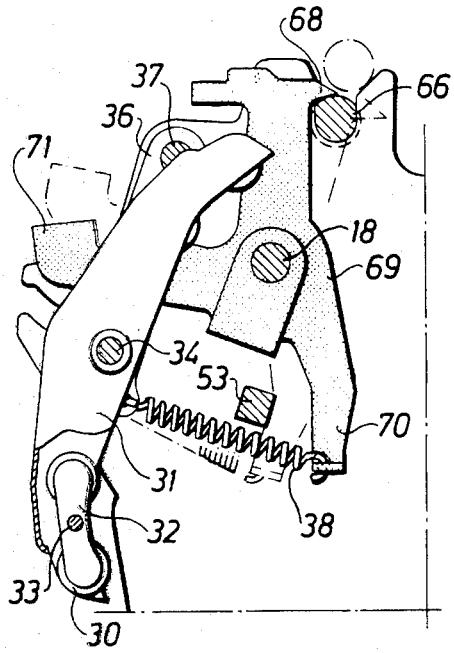
FIG. 3 is a section taken along line A—A in FIG. 1 wherein certain parts have been excluded and wherein a tractor cover with idle rollers has been shown in two different positions corresponding to friction feeding of paper sheets and pin wheel feeding of continuous forms, respectively.
Figure 4:
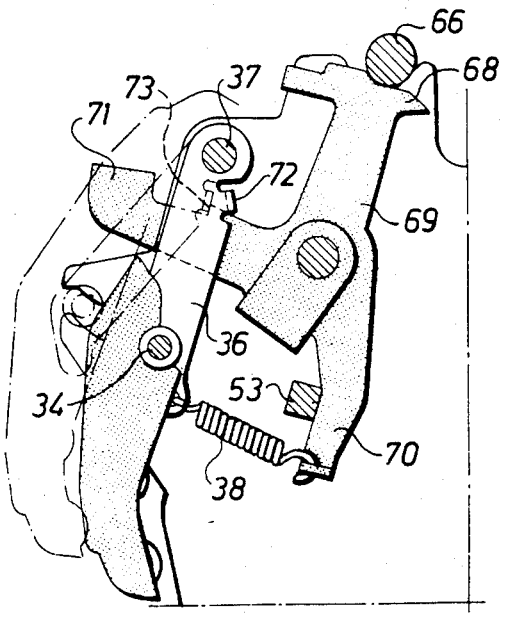
FIG. 4 is a section as in FIG. 3, however showing the tractor cover with the idle rollers in a continuous-form loading position.

As appears from FIGS. 3 and 4, the actuating lever 69 has a downward part 70, the free end of which is connected to the spring 38. As indicated above, at the respective end wall 11, 12 the opposite end of the spring 38 is secured to the arm 36 supporting the shaft 34. Hence, the position taken by the part 70 of the actuating lever determines the pressure exerted by the idle rollers 30 in the tractor covers 31. In the friction feed mode this pressure shall be a predetermined magnitude which is achieved when the actuating lever 69 has taken the position shown in FIG. 3. The friction feed mode is associated with the presence of a sheet magazine, and therefore the shaft 66 in the grooves 67 in the end walls determines the corresponding turning position of the actuating lever.

When feeding continuous forms the elevated pressure exerted by the idle rollers, when in the friction feed mode, is not needed. However, it has shown to be advantageous to have the friction feed means act on the continuous form simultaneously as the form is being fed by the pin wheels 41, 49. In this case, however, the friction force shall have a lower value which will be achieved automatically by the fact that upon removal on the shaft 66 together with the sheet magazin the actuating lever 69 is operated by the spring 38 to turn clockwise to a position wherein the part 70 bears on the shaft 53. This position of the actuating lever is indicated in FIG. 3 by dashed lines and in FIG. 4 by continuous lines. In order to release the shaft 66 from the locking part 68 the actuating lever is provided with an opening arm 71, which when being pushed down turns the actuating lever counterclockwise and, accordingly, the locking part 68 away from the groove 67 in the respective end wall 11, 12. Then, the shaft 66 together with the sheet can be removed.

For the feed of continuous forms the shaft 34 with the tractor covers 31 can be moved into the loading position, shown in FIG. 4 by dashed lines. The shaft can be locked in the loading position by a bent-over edge 72 on the arm 36 engaging an edge 73 on the actuating lever 69. By pushing-down of the operating arm 71 the shaft 34 can be released for return movement to the position shown in FIG. 3.

From the described embodiment it appears that the paper feed mechanism according to the invention by the use of simple change-over measures can be used for either friction feed of sheets of paper from a sheet magazine or for pin-wheel feed of continuous forms at which the friction feed remains at a reduced pressure. This is of great importance in precise feed of continuous forms. Tolerances in the feed holes of the forms as well as the feed pins of the pin wheels involve a small play between the holes and the pins, as seen in the direction of feed, and the influence of this play can be reduced if the friction feed remains operative. In the friction feed mode, the pin wheel drive means can be moved sideways into positions completely outside the paper sheet area.

What is claimed is:

1. A feed mechanism for feeding a printer or typewriter with sheets of paper or with a continuous web having feed holes, said mechanism comprising friction drive means for frictionally engaging and driving the sheets of paper or the continuous web, means for driving the friction drive means including a first rotatable drive shaft, web feed means including a pair of pin wheels having projections engageable in holes in the web for driving the web together with the drive thereof by the friction drive means, said friction drive means including two separate feed units which are displaceable towards and away from one another in a direction perpendicular to the direction of feed of the sheets or web, each said unit including a friction drive wheel, said pin wheels also being relatively displaceable in a direction perpendicular to the direction of feed of the sheets or web, said web feed means and said friction drive means including means for selectively coupling said pin wheels with respective friction drive means in driving relation for the drive of the web, said rotatable drive shaft supporting said pin wheels and the friction drive wheels for common rotation therewith, each unit including a housing in which the respective friction drive wheel is arranged, and a second shaft having a square cross-section, said second shaft being turnable, said housing having a non-circular hole in which said second shaft is received for locking of the housing on said second shaft when the second shaft is turned towards one angular position in the non-circular hole and for releasing the housing when the shaft is turned towards a second angular position in the non-circular hole whereby to selectively lock the units.

2. A feed mechanism as claimed in claim 1 wherein said friction drive means has two operating states in one of which greater frictional force is applied to drive the sheets of paper and in the other of which lesser frictional force is applied to drive the web.

3. A feed mechanism as claimed in claim 1 wherein each said feed unit includes a second friction drive wheel in the associated housing, and a transmission means drivingly connecting the first and second friction drive wheels of each unit, said web feed means including a second pair of pin wheels, and a third shaft supporting said second friction drive wheels and said second pair of pin wheels for free rotation thereon.

4. A feed mechanism as claimed in claim 3 comprising a fourth shaft extending parallel to said first drive shaft, and idler roller means for each unit pivotably and slidably mounted on said fourth shaft for pressing the sheets of paper or the web against the friction drive means.

5. A feed mechanism as claimed in claim 4 wherein said idler roller means comprises a cover partly enclosing the associated feed unit and pressure rollers supported by said cover, and means for positioning said cover relative to the associated feed unit.

6. A feed mechanism as claimed in claim 5 comprising a frame including two end walls supporting the four said shafts, said fourth shaft being swingably journaled in said end walls, and spring means urging said fourth shaft and said covers of said idler roller means thereon towards said feed units.

7. A feed mechanism as claimed in claim 6 further comprising means for displacing said fourth shaft against the action of said spring means to a paper loading position in which said covers are spaced away from the respective feed unit and locking means for releasably locking said fourth shaft in the paper loading position.

8. A feed mechanism for feeding a printer or typewriter with sheets of paper or with a continuous web having feed holes, said mechanism comprising friction drive means for frictionally engaging and driving the sheets of paper or the continuous web, means for driving the friction drive means, web feed means including projections engageable in holes in the web for driving the web together with the drive thereof by the friction drive means, said friction drive means and said web feed means including means for selectively and releasably connecting the friction drive means and the web drive means together in driving relation, including two separate units which are displaceable towards and away from one another in a direction perpendicular to the direction of feed of the sheets or web, said friction drive means having a first operating state for frictional drive of said sheet of paper and a second operating state for frictional drive of said web, the frictional force applied by the friction drive means in said first operating state being greater than that in said second operating state, said friction drive means including a cover for each unit including means for applying pressure to a sheet of paper or a web between the cover and the respective unit, a shaft supporting the covers of the units, a housing including spaced end walls between which are arranged said units, said end walls having recesses for receiving a shaft of a magazine for sheets of paper, and means for setting the operating state of said friction drive means depending on the presence or absence of said magazine shaft in said recesses, the latter means comprising an actuating lever pivotably supported by one of said end walls and spring means connected to said actuating lever and to said cover support shaft, said actuating lever including an operating part which in the absence of a magazine shaft in said recesses permits said actuating lever to pivot and relieve the force of said spring means to establish said second operating state whereas with said magazine shaft in said recesses said operating part is limited in its pivotal extent by said magazine shaft and the force of the spring means is not relieved to establish said first operating state.

9. A feed mechanism as claimed in claim 8 comprising an abutment, said actuating lever including an impact part which contacts said abutment in said second operating state and establishes the relieved force of the spring means.

10. A feed mechanism as claimed in claim 9 comprising a link secured to said cover support shaft, said link being pivotably connected to said one end wall and including means for releasably locking said cover support shaft in a paper sheet loading position.

* * * * *